US007007831B2

(12) United States Patent
Pennaneac'h et al.

(10) Patent No.: US 7,007,831 B2
(45) Date of Patent: Mar. 7, 2006

(54) FLUID DISPENSER

(75) Inventors: Hervé Pennaneac'h, Verneuil-sur-Avre (FR); Christophe Pierre, Evreux (FR)

(73) Assignee: Valois SAS, Le Neubourg (FR)

( * ) Notice: Subject to any disclaimer, the term of this patent is extended or adjusted under 35 U.S.C. 154(b) by 0 days.

(21) Appl. No.: 10/809,905

(22) Filed: Mar. 26, 2004

(65) Prior Publication Data

US 2004/0188461 A1 Sep. 30, 2004

Related U.S. Application Data

(60) Provisional application No. 60/501,246, filed on Sep. 9, 2003.

(30) Foreign Application Priority Data

Mar. 27, 2003 (FR) ..... 03 03752

(51) Int. Cl.
*B05B 11/16* (2006.01)

(52) U.S. Cl. ..... 222/633; 222/212; 222/215; 222/192; 222/105; 222/103; 239/327

(58) Field of Classification Search ..... 222/633, 222/103, 105, 212, 215, 192; 239/327
See application file for complete search history.

(56) References Cited

U.S. PATENT DOCUMENTS

| | | | | |
|---|---|---|---|---|
| 2,432,288 | A | 12/1947 | Danziger | |
| 2,788,921 | A | 4/1957 | Galinas | |
| 3,897,005 | A * | 7/1975 | Reiner | 239/327 |
| 4,923,063 | A * | 5/1990 | Tararuj | 206/484 |
| 4,941,574 | A * | 7/1990 | Meehan | 206/466 |
| 4,998,621 | A * | 3/1991 | Meehan | 206/466 |
| 5,950,871 | A * | 9/1999 | de Pous et al. | 222/88 |
| 6,021,930 | A * | 2/2000 | de Pous et al. | 222/633 |
| 6,264,065 | B1 * | 7/2001 | Jouillat | 222/94 |
| 6,536,635 | B1 * | 3/2003 | Garcia et al. | 222/633 |
| 6,540,079 | B1 * | 4/2003 | Garcia et al. | 206/484 |
| 6,651,846 | B1 * | 11/2003 | Duquet et al. | 222/103 |
| 6,655,549 | B1 * | 12/2003 | Duquet et al. | 222/103 |
| 6,663,019 | B1 * | 12/2003 | Garcia et al. | 239/327 |
| 6,736,335 | B1 * | 5/2004 | Cuthbert | 239/327 |
| 6,752,298 | B1 * | 6/2004 | Garcia et al. | 222/633 |
| 6,769,579 | B1 * | 8/2004 | Milian | 222/212 |
| 6,811,057 | B1 * | 11/2004 | Duquet et al. | 222/105 |
| 2003/0094466 | A1 * | 5/2003 | Duquet et al. | 222/212 |
| 2003/0230599 | A1 * | 12/2003 | Duquet et al. | 222/214 |

FOREIGN PATENT DOCUMENTS

| | | | |
|---|---|---|---|
| FR | 2 791 645 | A | 10/2000 |
| GB | 626 631 | A | 7/1949 |
| JP | 07061165 | A * | 3/1995 |

* cited by examiner

*Primary Examiner*—Kenneth Bomberg
(74) *Attorney, Agent, or Firm*—Sughrue Mion, PLLC

(57) ABSTRACT

A fluid dispenser comprising: a fluid reservoir (12) defining at least one actuating wall (21) suitable for being displaced; a dispensing orifice (41); and spring means (7) suitable for loading the actuating wall into a state in which the volume of the reservoir is at its maximum; said fluid dispenser being characterized in that the spring means (7) co-operate with cocking means (11) suitable for bringing the spring means to a state loading the actuating wall from an initial state in which the spring means do not load the actuating wall.

14 Claims, 3 Drawing Sheets

FLUID DISPENSER

CROSS REFERENCE TO RELATED APPLICATION

This application claims the benefit under 35 U.S.C. §119 (e) of pending U.S. provisional patent application Ser. No. 60/501,246, filed Sep. 9, 2003, and priority under 35 U.S.C. §119(a)–(d) of French patent application No. FR-03.03752, filed Mar. 27, 2003.

TECHNICAL FIELD OF THE INVENTION

The present invention relates to a fluid dispenser comprising a fluid reservoir defining a displaceable or deformable actuating wall that is suitable for being displaced or pushed in, a dispensing orifice, and spring means suitable for loading the deformable wall into a state in which the volume of the reservoir is at its maximum.

BACKGROUND OF THE INVENTION

For example, the dispenser or at least the reservoir can be made up from one or two flexible sheets forming the actuating wall. By pushing in the actuating wall against the spring means, it is possible to reduce the internal volume of the reservoir, and fluid is thus delivered through the dispensing orifice. That is a conventional design for a dispenser in the fields of perfumes, of cosmetics, or indeed of pharmaceuticals. In certain fields, it is advantageous for fluid to be dispensed in the form of a spray.

When the actuating wall is deformable, the spring means act on the wall to deform it towards a maximum deformed state in which it defines a maximum volume state for the reservoir. Deforming the deformable wall by using spring means is not always attractive and can adversely affect the appearance of the dispenser. In addition, the spring means increase the total thickness of the dispenser, and that can be a major drawback in certain uses.

Document FR-2 791 645 discloses a dispenser of that type in which the dispensing orifice is closed off by a removable closure member prior to use. The inside of the reservoir therefore does not communicate with the outside and, in that document, the spring that acts on a deformable wall is compressed to a maximally compressed state, so that the thickness of the dispenser can maintained at a minimum. That is an essential requirement when such a dispenser is to be inserted in magazines in the form of a fluid sample. Even when the dispensing orifice is closed off, the spring naturally acts against the deformable wall, thereby unattractively deforming the deformable wall which then often presents uneven relief.

Prior art dispensers are also known in which the actuating wall is not deformable, but rather merely displaceable.

SUMMARY OF THE INVENTION

An object of the present invention is to remedy the above-mentioned drawback of the prior art by defining a fluid dispenser whose spring means do not adversely affect the attractiveness of the appearance of the actuating wall, at least prior to the dispenser being used. Another object is to make it possible to cock the spring means practically, rapidly, and preferably intuitively.

To these ends, the present invention provides for the spring means to co-operate with cocking means suitable for bringing the spring means to a state loading the actuating wall from an initial state in which the spring means do not load the actuating wall, the spring means comprising a front plate and a back plate, the reservoir being situated between and secured to the front and back plates, the cocking means comprising spacer means that can be displaced selectively between an inoperative position in which the two plates extend substantially parallel to each other and corresponding to a state in which the volume of the reservoir is at its minimum, and an operative position in which the plates are spaced apart from each other at least locally, the front plate being movable relative to the back plate so as to compress the reservoir situated between them, actuating means being provided for positioning the spacer means between the two plates so as to space them apart, the actuating means comprising a traction member provided with a fixing end connected to the spacer means and with a traction end, the traction end being situated in the vicinity of the dispensing orifice.

Thus, the spring means do not act on the actuating wall in the initial state, and the cocking means are used to impart to the spring means their genuine and desired function, i.e. to load the actuating wall. The dispenser of the invention may therefore be stored prior to use in a state in which the spring means do not act on the actuating wall. When it is not loaded, the actuating wall remains stress-free and can thus have a suitably attractive appearance. The actuating wall and the dispenser can then remain in an entirely flat state suitable for being used as a sample in magazines.

In one aspect of the invention, the dispensing orifice is closed off by a removable closure member secured to the traction member. In a variant, the dispensing orifice is closed off by a removable closure member provided with a pull tab, the traction end being formed by said pull tab.

The fact that the traction end is situated directly in the vicinity of the dispensing member makes it possible for the way in which the dispenser is used to be understood rapidly and even intuitively, because it is quite natural to remove the closure member of a dispenser by pulling on a tab that is associated with it. Users think they are merely removing the closure member, whereas in reality they are also actuating the cocking means. In other words, the act of actuating the cocking means is completely masked by the act of removing the closure member.

According to another characteristic of the invention, the spacer means and the actuating means are implemented integrally in one piece. Advantageously, the spacer means comprise a hinged flap mounted to move between the inoperative position and the cocked position, said flap and the traction member being implemented integrally in one piece.

In addition, the traction member may extend between the two plates.

In a practical embodiment, the traction member forms a fork comprising two prongs interconnected via a common web, the two prongs defining two connection ends together forming said fixing end. Advantageously, the traction member comprises a tab connected to the web, said tab defining a free end connected to or forming the traction end. Advantageously, the tab is detachable from the fork. More generally, the traction end is detachable from the remainder of the traction member.

In another aspect, the reservoir is fixed to a plate between the two prongs of the fork.

In addition, the spring means are formed by at least one of the following elements: the front plate, the back plate, and the spacer means.

According to a practical characteristic, the reservoir almost exclusively contains fluid before the removable dispensing member is removed.

BRIEF DESCRIPTION OF THE DRAWINGS

The invention is described more fully below with reference to the accompanying drawings which give an embodiment of a dispenser of the invention by way of non-limiting example.

In the figures.

DETAILED DESCRIPTION OF THE INVENTION

Figure 1:
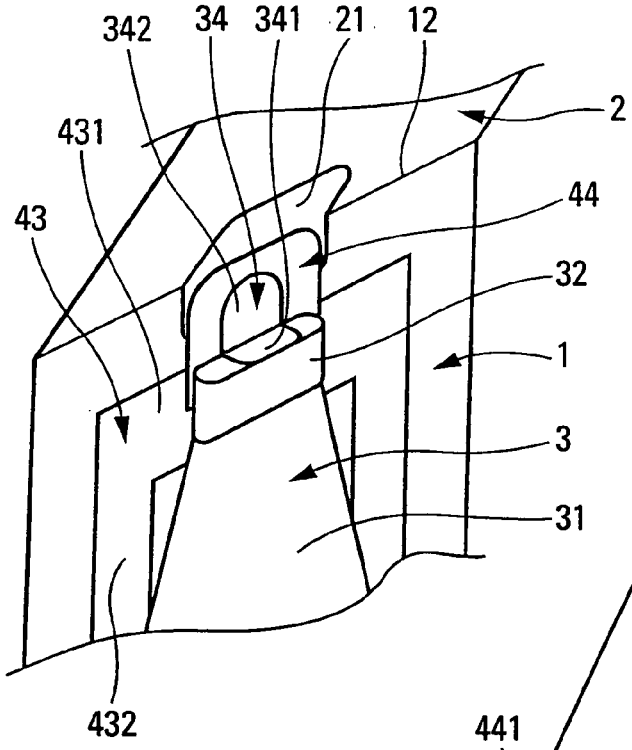
FIG. 1 is a view in perspective and from above showing a dispenser of the invention in an unfinished state in order to show its internal structure.

The dispenser includes a pouch 3 containing fluid in liquid form or in powder form. In this example, the pouch is made up from a deformable flexible sheet 31 that is folded in half and fixed in sealed manner around its periphery. Advantageously, the sheets or half-sheets may be fixed together in sealed manner by heat-sealing. A fluid reservoir 30 of variable volume is thus defined. The flexible sheet 31 forms a deformable or push-in actuating wall. The dispenser is further provided with a dispensing orifice 321 which, in this example, is preferably a spray orifice. Said orifice is preferably formed by a dispensing head 32 made of a rigid plastics material and defining an outlet channel whose downstream end forms the dispensing orifice. The sheet 31 is advantageously sealed to the dispensing head. The orifice 321 is advantageously closed off by a removable closure member at least prior to being used for the first time, which closure member comprises a closure portion 341 and a fastening portion 342.

Thus, after the removable closure member has been removed from the dispensing orifice, it is possible to press on the sheet, thereby reducing the working volume of the reservoir 30, and the fluid stored in the reservoir is then delivered through the channel and through the dispensing orifice. Advantageously, the reservoir further includes a piece of porous material suitable for being soaked or impregnated with fluid in liquid form or in powder form. Preferably, said piece is positioned in direct contact with the dispensing orifice 321 or with the outlet channel.

The dispenser also includes spring means and cocking means which, in this example, are in the form of a top plate 2 and of a bottom plate 1, associated with a pivotally mounted flap 42 and with a traction member 43 for causing the flap to pivot. The flap 42 performs a function as cocking means for activating the spring means. It may also perform a spring function. At least one of the two plates is elastically deformable so as to perform a spring function, if the flap does not perform such a function. Preferably, both of the plates 1 and 2 may be made from a single piece of plate, the two portions of plate being interconnected via a connection fold 12, as shown in the figures. A cutout or notch 21 is formed at the connection fold 12. The notch may be formed by a window which straddles the fold and which is then folded in half. The dispensing orifice 321 with its removable closure member is positioned in said notch 21.

The plate 1 is formed by a panel 10 and two side flaps 11 which can be folded over onto the panel. The plate 2 is connected to the panel 10 via the fold 12. The size of the plate 2 is substantially the same as the size of the panel 10, so that they can be mutually superposed.

A fixing stub 41 is advantageously bonded to the panel 10 with adhesive. The stub may also be formed integrally with the plate 1. The flap 42 is hinged relative to the stub 41 to pivot about a line 412. The flap serves as cocking means in the form of spacer means, as explained below. The flap is further provided with a small locking tongue 422 whose function is explained below. The stub and the flap may be formed in one piece. The flap is advantageously situated in the vicinity of the edge opposite from the fold 12.

The plate 2 is formed with a slot 22 serving to receive the locking tongue 422 on the plate 1.

The plates are designed to be fixed together at the side flaps 11, advantageously by heat-sealing. A sort of envelope is thus obtained that is sealed along three sides and open on the side on which the hinged flap 42 is formed. The flexible pouch 3 is disposed between the two plates inside the envelope that they form together. The dispensing orifice 321 is advantageously positioned centrally at the notch 21. The pouch 23 may advantageously be fixed inside the envelope constituted by the two plates. For example, the pouch may be fixed at two points 311 and 312 to respective ones of the plates.

Figure 3:
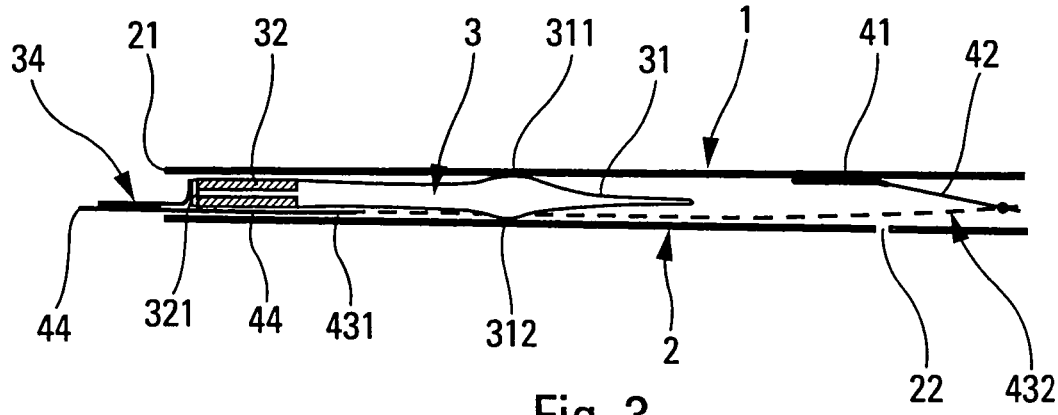
FIGS. 3, 4, and 5 are vertical section views through the dispenser of FIGS. 1 and 2, respectively in the rest position, in the cocked position, and in the actuated position.

When the flap 42 extends in the same plane as the remainder of the plate 1, as shown in FIGS. 1 and 3, the plate 2 extends substantially parallel to the plate 1, with the flexible pouch 3 interposed between the two plates. Advantageously, the flexible pouch 3 contains only very little fluid, so that it can have a configuration that is particularly flat. Thus, when disposed between the two plates 1 and 2, it generates only a very small amount of extra thickness, and the two plates thus seem to be mutually superposed with almost nothing between them. This is shown in FIG. 3. The total thickness of the dispenser may be approximately in the range 2 millimeters (mm) to 3 mm. The dispenser is then in a rest state suitable for it being transported or stored. The flexible pouch 3, which forms the actuating walls, is not subjected to any stress. Similarly, the plates 1 and 2 are not subjected to any stress.

Figure 4:
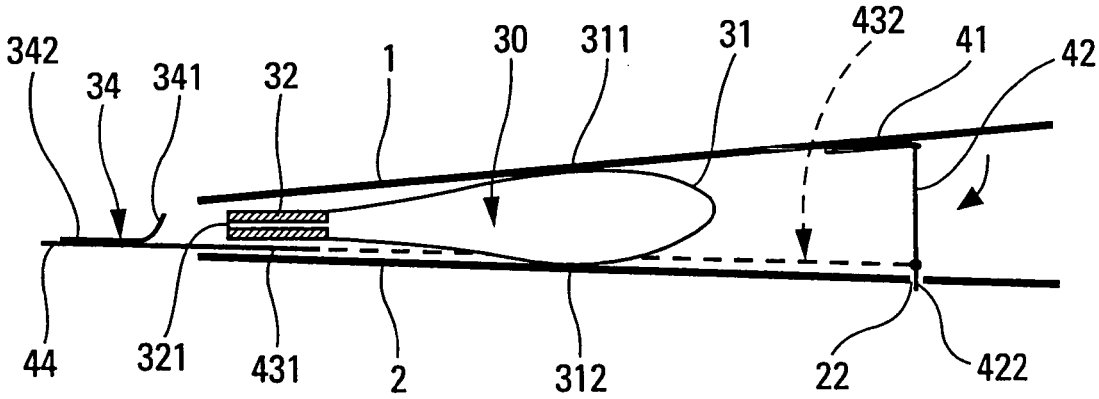

For the purpose of cocking the dispenser, it is necessary merely to cause the flap 42 to pivot about the hinge line 412 towards the plate 2, as indicated by the small arrow in FIG. 4. The fold line 412 is advantageously curved, e.g. in the shape of an arc of a circle. Symmetrically, that edge of the flap on which the tongue is formed may also be curved. Thus, when the flap 42 pivots towards the plate 2, the plates take up a curvature corresponding to the fold line and to the free edge. The flap is pivoted until its free edge comes into abutment against the plate 2, and until its small locking tongue 422 is received in the window 22 formed in the plate 2. This is shown in FIG. 4. The flap then extends substantially perpendicularly both to the plate 1 and to the plate 2. Because the tongue 422 is engaged in the window 22, the flap is locked in position. For example, the flap may be implemented rigidly. It then constitutes spacer means which make it possible to hold the two plates spaced apart.

Since the pouch 3 is fixed to the plate 1 at 311 and to the plate 2 at 312, the two plates being spaced apart by interposing the spacer flap also causes the walls of the pouch to be spaced apart. The internal volume of the reservoir thus increases by air flowing into it through the dispensing orifice 321, and advantageously through the piece of porous material. Naturally, this is possible only after the removable closure member 34 has been removed. Except by destroying the dispenser, it is almost impossible to fold back the flap to position it as shown in FIG. 4 without having previously removed the closure member. It is possible to space the plates apart only if air can penetrate into the reservoir. In the invention, the plates are made of an elastically deformable material which imparts this resilient return characteristic to them. Thus, once the dispenser is in the configuration shown in FIG. 4, it is possible to actuate it by pressing on the plate with one finger while holding the plate with another finger. In this embodiment, each of the plates forms return spring means. However, it is possible to imagine an embodiment in which only one of the plates forms resilient return means, while the other plate can be fully rigid and can serve as a backing surface. It is also possible to imagine that only the flap is resiliently deformable while the plates are rigid. A flexible flap and a deformable plate may also be considered.

It is possible bring the plates towards each other by deforming the pouch. This puts the reservoir 30 under pressure and delivers a mixture of air and of fluid through the dispensing orifice.

It can thus be observed that the spacer flap 42 forms cocking means for bringing the plates into a spaced-apart configuration.

In this example, the spring and cocking means are in the form of an envelope that surrounds the flexible pouch 3. It is also possible to imagine embodiments in which the spring and cocking means are in the form of two narrow strips or blades, one of which is provided with a cocking spacer flap. The flexible pouch 3 is then disposed between the two strips.

In the invention, the fluid dispenser is provided with control means which are designated overall by the numerical reference 4 in FIG. 1. The definition of these actuating means may further comprise the flap 42 and the fixing stub 41 since said flap and said stub can be formed integrally with the remainder of the actuating means 4. The actuating means 4 comprise a traction member which extends between the flap 42 and the notch 21. The traction member is connected, advantageously in integral manner, to that edge of the flap 42 on which the locking tongue 422 is formed. In addition, the traction member is provided with a traction end 442 that is initially positioned in the notch 21. By pulling on the traction end 442, it is possible to cause the traction member to transmit the traction force to the flap 42 which is then caused to pivot from its inoperative position shown in FIG. 3 to its cocked position shown in FIG. 4. The final position is the position in which the locking tongue 442 is received in the window 22 of the plate 2. The user immediately understands that it is necessary to take hold of the traction end 442 and to pull on it.

The traction member extends between the two plates 1 and 2.

Preferably, the removable closure member 34 is secured to the traction member so that, by pulling on the traction end 442, it is possible simultaneously to cock the dispenser and to remove the removable closure member in order to uncover the dispensing orifice 321.

This is the general concept implemented by the actuating means of the invention.

Figure 2:
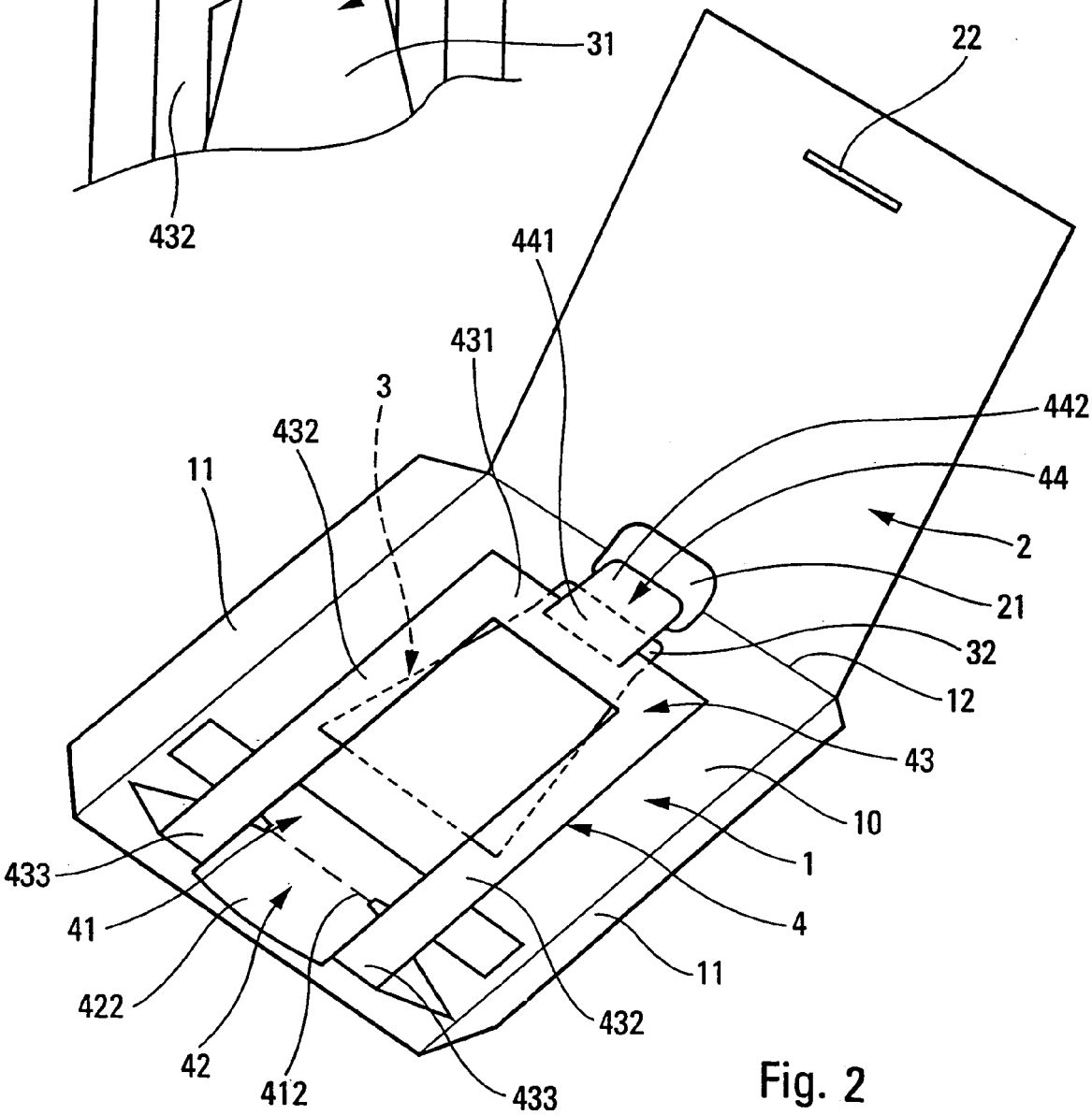
FIG. 2 is a fragmentary perspective view of the other face of the dispenser shown in FIG. 1.
Figure 5:
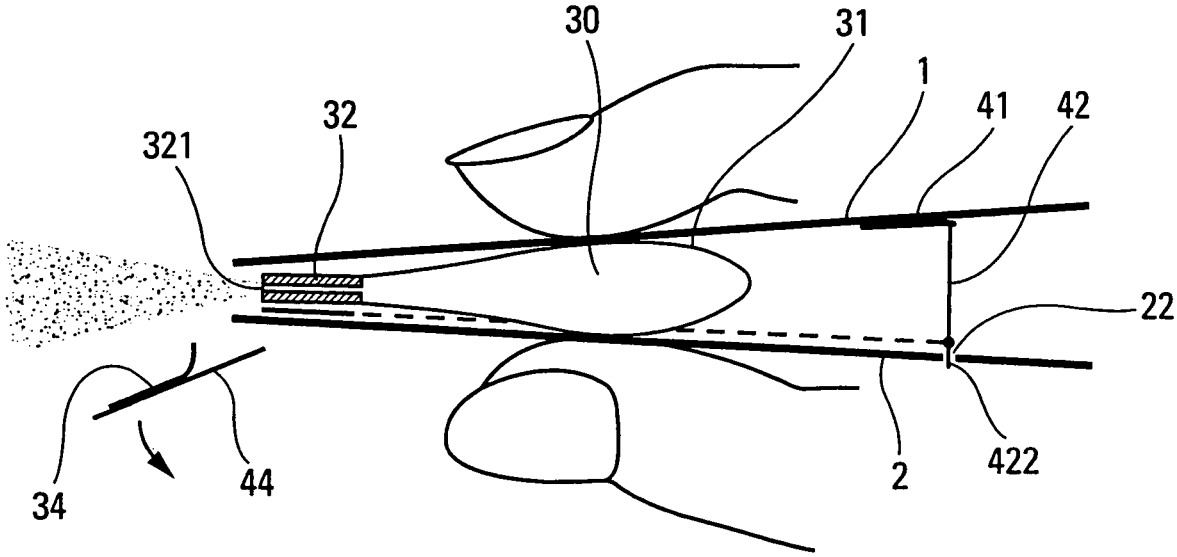

The figures serving to illustrate the present invention give a very practical embodiment of the actuating means 4. More particularly with reference to FIG. 1, it is possible to see that the actuating means 4 comprise a force-transmitting fork 43 and a pull tab 44. The fork and the tab may be implemented integrally, or in a variant, the tab 44 may be fixed, e.g. by bonding with adhesive, to the fork 43. The fork 43 comprises two substantially parallel side prongs 432, each connected at a respective one of its ends to a common web 431. The prongs 432 extend substantially parallel to the side flaps 11 of the plate 1. The web 431 is situated in the vicinity of the notch 21. The prongs 432 define connection ends 433 that are connected to the flap 42 on either side of the locking tongue 422. The fork 43 and the flap 42 may be made in integral manner, advantageously together with the fixing stub 41. The pull tab 44 is connected to the fork 43 at the common web 431. The tab has a traction free end 442 positioned in the notch 21 and a fixing stub 441 connected detachably to the web 431. The removable closure member 34 advantageously comprises a closure portion 431 positioned in leaktight manner over the dispensing orifice 321 and a fastening portion 342 fixed to the tab 44. This can be seen clearly in FIG. 2. Initially, before the device is used for the first time, the flap 42 is pressed against the plate 1. The traction end 442 is then positioned in the notch 21 without projecting outwards therefrom. The user can take hold of the traction end 442 and pull on it so as to cause the flap 42 to pivot and so as to detach the closure portion 341 from the dispensing orifice. By continuing to pull, the user detaches the tab 44 from the fork 43. This can be seen in FIG. 5. The removable closure member 34 may remain fixed to the tab 44 as can be seen in FIG. 5.

The flexible pouch 3 is disposed between the fork 43 and the plate 1, as can be seen in FIG. 1, the flexible pouch 3 being shown in dashed lines. The fork shape makes it possible firstly to improve the distribution of the traction forces on the flap 42, and secondly to fix the pouch 3 in centered manner at the point 312 that is shown in FIGS. 3 and 4, and that is situated between the two prongs. The fork shape also makes it possible to establish abutting contact between the common web 431 and the fold 12 at the end of traction, thereby resulting in the tab 44 being detached from the fork 43.

In a variant, it is also possible to imagine the traction end being formed by the fastening portion 342 of the removable closure member 34 which then forms a pull tab suitable for being grasped by the user. However, the preferred embodiment implements one piece forming the transmission fork 43, the hinged flap 42, and the fixing stub 41. The two sheets 1 and 2 are also implemented in one-piece manner. The pull tab 44 is fixed to the fork, and the removable closure member 34 is mounted on the dispensing orifice and on the tab.

Figure 6:
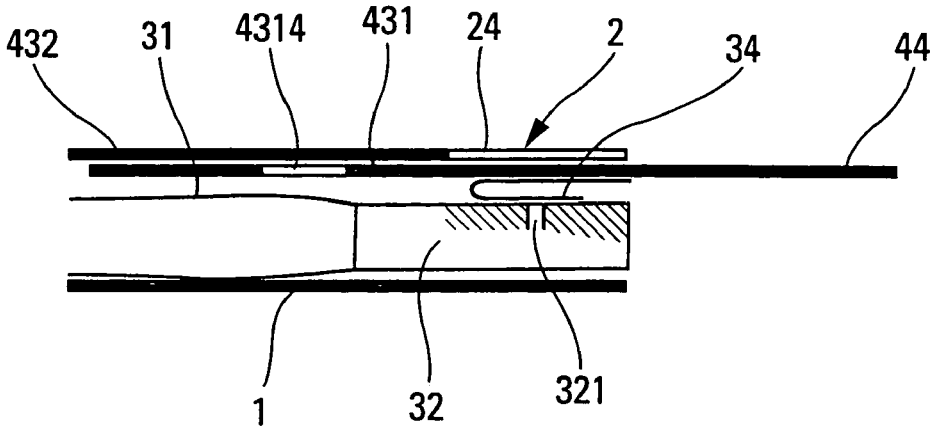
FIGS. 6, 7, and 8 are views similar to FIGS. 3, 4, and 5, showing a variant embodiment of the invention.
Figure 7:
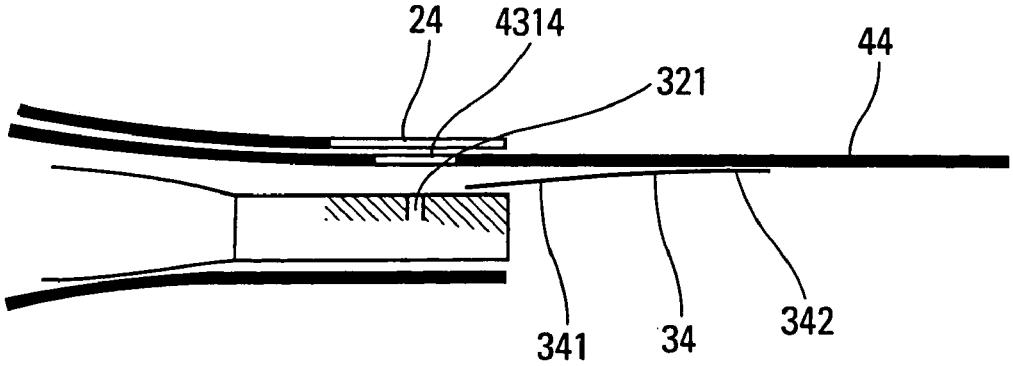
Figure 8:
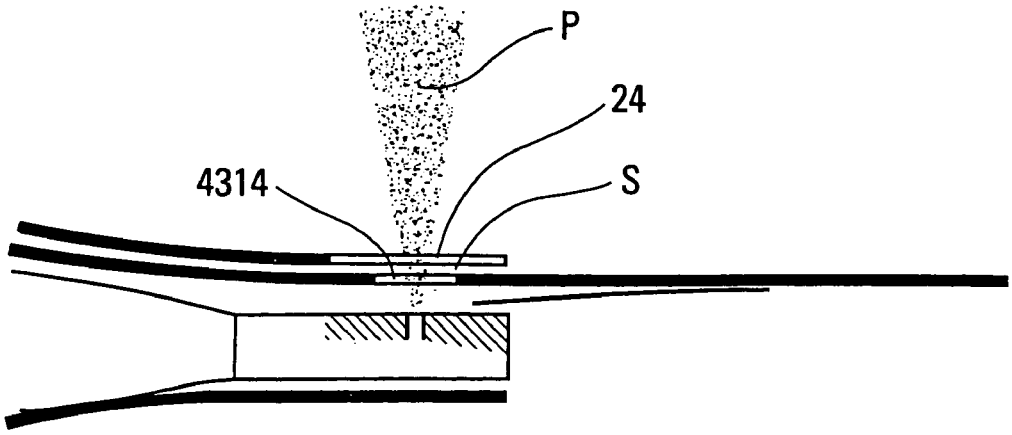

In the embodiment shown in FIGS. 6, 7, and 8, the dispensing orifice 321 opens out on one side of the dispensing head rather than at the top of the dispensing head as it does in the preceding embodiment. This is substantially the only difference relative to the preceding embodiment. The actuating means, and in particular the traction member may be identical or almost identical. As a result, the orifice is directed towards the traction member and the plate 2.

More precisely, when the dispenser is in its initial state, as shown in FIG. 6, the pull tab 44 is positioned in the notch 21; the removable closure member 34 masks the orifice 321 and is connected to the tab 44, and the tab 44 is connected to the web 431 of the fork 43. The tab or the web is situated just in front of the orifice as still closed off. The web is provided with an opening 4313 which is offset relative to the orifice. The plate 2 is provided with a window 24 at which the orifice is positioned. It is thus possible to take hold of the tab 44 in the notch 21 and to pull on it. This displaces the fork: the flap 42 is raised and the closure portion 341 is lifted off the orifice via the fastening portion 342 fixed to the tab.

At the end of traction, the orifice is completely unobstructed, and the opening 4314 has been shifted to be in register with the orifice and to be substantially centered relative to the window 24 in the plate 2. By continuing to pull on the tab, it is optionally possible to cause said tab to become detached from the fork at the point S, so that the notch 21 remains empty. By squeezing the plates together, the fluid is delivered in sprayed form through the orifice. The jet or spray is diffused through the opening 4314 and through the window 24. The axis of the spray is substantially perpendicular to the plane of the plate 2.

By means of this particular traction member, the user can, by performing a single intuitive action, open up the dispensing orifice and bring the spring means into an operative condition.

What is claimed is:

1. A fluid dispenser comprising:

a fluid reservoir (30) defining at least one actuating wall suitable for being displaced;

a dispensing orifice (321); and spring means (1; 2; 42) suitable for loading the actuating wall into a state in which the volume of the reservoir is at its maximum;

said fluid dispenser being characterized in that the spring means co-operate with cocking means (42) suitable for bringing the spring means to a state loading the actuating wall from an initial state in which the spring means do not load the actuating wall, the spring means comprising a front plate (1) and a back plate (2), the reservoir (30) being situated between and secured to the front and back plates, the cocking means comprising spacer means (42) that can be displaced selectively between an inoperative position in which the two plates extend substantially parallel to each other and corresponding to a state in which the volume of the reservoir is at its minimum, and an operative position in which the plates are spaced apart from each other at least locally, the front plate being movable relative to the back plate so as to compress the reservoir situated between them, actuating means (4) being provided for positioning the spacer means between the two plates so as to space them apart, the actuating means comprising a traction member (43, 44) provided with a fixing end (433) connected to the spacer means (42) and with a traction end (442), the traction end being situated in the vicinity of the dispensing orifice (321).

2. A dispenser according to claim 1, in which the dispensing orifice is closed off by a removable closure member (34) secured to the traction member (44).

3. A dispenser according to claim 1, in which the dispensing orifice is closed off by a removable closure member provided with a pull tab, the traction end being formed by said pull tab.

4. A dispenser according to claim 1, in which the spacer means (42) and the actuating means (4) are implemented integrally in one piece.

5. A dispenser according to claim 4, in which the spacer means comprise a hinged flap (42) mounted to move between the inoperative position and the cocked position, said flap and the traction member (43) being implemented integrally in one piece.

6. A dispenser according to claim 1, in which the traction member (43) extends between the two plates.

7. A dispenser according to claim 1, in which the traction member forms a fork (43) comprising two prongs (432) interconnected via a common web (431), the two prongs defining two connection ends (433) together forming said fixing end.

8. A dispenser according to claim 7, in which the traction member comprises a tab (44) connected to the web (431), said tab defining a free end (442) connected to or forming the traction end.

9. A dispenser according to claim 8, in which the tab is detachable from the fork.

10. A dispenser according to claim 7, in which the reservoir (30) is fixed to a plate (1) between the two prongs of the fork.

11. A dispenser according to claim 1, in which the traction end is detachable from the remainder of the traction member.

12. A dispenser according to claim 11, in which the spring means are formed by at least one of the following elements: the front plate, the back plate, and the spacer means.

13. A dispenser according to claim 2, in which the reservoir (30) almost exclusively contains fluid before the removable dispensing member (34) is removed.

14. A dispenser according to claim 1, in which the dispensing orifice (321) opens out to one side through one of the plates.

* * * * *